US009595254B1

(12) United States Patent
Haverstick et al.

(10) Patent No.: US 9,595,254 B1
(45) Date of Patent: Mar. 14, 2017

(54) ADAPTIVE ACOUSTICAL TREATMENT ASSEMBLY

(71) Applicant: Acoustical Fulfillment LLC, Forked River, NJ (US)

(72) Inventors: Gavin A. Haverstick, Indianapolis, IN (US); Katherine C. Cardwell, Parkville, MD (US); Garnett J. Callis, Lanoka Harbor, NJ (US)

(73) Assignee: Acoustical Fulfillment LLC, Forked River, NJ (US)

( * ) Notice: Subject to any disclaimer, the term of this patent is extended or adjusted under 35 U.S.C. 154(b) by 0 days.

(21) Appl. No.: 14/834,728

(22) Filed: Aug. 25, 2015

(51) Int. Cl.
*G10K 11/20* (2006.01)
*G10K 11/168* (2006.01)

(52) U.S. Cl.
CPC ..... *G10K 11/20* (2013.01); *G10K 11/168* (2013.01)

(58) Field of Classification Search
CPC ..... G10K 11/20
USPC ..... 181/286, 284
See application file for complete search history.

(56) References Cited

U.S. PATENT DOCUMENTS 5,741,369 A * 4/1998 Yamamura ..... E01F 8/0017 136/251
6,158,176 A * 12/2000 Perdue ..... E04B 1/86 181/284
6,457,554 B1 * 10/2002 Wang ..... E04B 1/84 181/198
8,561,360 B2 * 10/2013 Corbin, Jr. ..... E01F 8/0011 256/24
8,925,678 B2 * 1/2015 Tizzoni ..... E01F 8/0035 181/210
2003/0006090 A1 * 1/2003 Reed ..... E01F 8/007 181/210
2003/0006092 A1 * 1/2003 D'Antonio ..... E04B 1/86 181/293
2005/0263343 A1 * 12/2005 Yano ..... B64F 1/26 181/210
2010/0243369 A1 * 9/2010 Fusiek ..... E01F 8/007 181/210
2011/0209426 A1 * 9/2011 Pollack ..... E04B 1/74 52/302.1
2015/0368899 A1 * 12/2015 Gimpel ..... E04B 1/994 181/284

* cited by examiner

*Primary Examiner* — Forrest M Phillips
(74) *Attorney, Agent, or Firm* — Maginot, Moore & Beck LLP

(57) ABSTRACT

An acoustical treatment assembly includes a frame, an absorption panel, and a removable diffuser element. The frame has opposing mounting channels. The absorption panel is disposed on the frame and at least in part between the mounting channels, and comprises an acoustically absorbent material. The removable diffuser element has a convex rounded shape and includes acoustically reflective material. Opposing edges of the diffuser element are disposed within the mounting channels.

17 Claims, 6 Drawing Sheets

ADAPTIVE ACOUSTICAL TREATMENT ASSEMBLY

FIELD OF THE INVENTION

The present invention relates generally to acoustical treatments for architectural spaces.

BACKGROUND OF THE INVENTION

Acoustical treatment has been used to enhance the acoustic quality of rooms and halls. Acoustical treatment is useful and largely necessary in both venues in which music is publicly performed, and in studios or other venues where music is recorded or even practiced. Without acoustical treatment, echoes, reverberation and other reflective features of venues can adversely affect the desired qualities of the sound.

A common form of acoustical treatment involves absorption. Absorption removes some or most of the undesired reverb or echo caused in venues with acoustically reflective walls. To this end, foam, fiberglass or other acoustically absorbent panels or devices are often disposed within the room at places where sound reflection is prevalent. Such absorbent panels operate to "deaden" the acoustic properties of the room.

One drawback of absorption techniques is that some of the higher frequency sounds can be de-emphasized. In many cases, this drawback is tolerable and worth the improvement from reverb and echo reduction. However, for certain types of music and sounds, absorption can provide a noticeable detriment. For example, acoustic stringed and percussion instruments can be significantly dampened by absorption equipment. For larger spaces, speech intelligibility can be negatively affected by over-absorption of high frequency energy.

To address this issue, moderate reverb and/or echo control can be achieved by another acoustical treatment involving sound diffusion. Sound diffusers are devices or systems that reflect and scatter incident sound waves to that the energy of the waves is diffused in many directions, as opposed to being concentrated. For example, the undesirable echo effects in rooms with large flat walls are caused by concentrated zones of reflected sound. Sound diffusers are shaped to reflect the sound in various directions to avoid or reduce concentrations. Because diffusers reflect sound, as opposed to absorbing sound, the sound is not deadened to the same degree, and high frequency energy is retained.

Currently, studios and performance halls must essentially select the absorption and/or diffusion desired for the venue. Because some types of music benefit more from diffusion and other types of music benefit more from absorption, it is difficult to have a single room that accommodates all types of music. Typically, a compromise must be arrived at that will be "good" for multiple applications, but potentially not "ideal" for a single one.

SUMMARY

The present embodiment represents a solution for the above-described issues by providing an acoustical treatment assembly that is adaptive between an absorption treatment and a diffusor treatment.

A first embodiment of the invention is an acoustical treatment assembly that includes a frame, an absorption panel, and a removable diffuser element. The frame has opposing mounting channels. The absorption panel is disposed on the frame and at least in part between the mounting channels, and comprises an acoustically absorbent material. The removable diffuser element has a convex rounded shape and includes acoustically reflective material. Opposing edges of the diffuser element are disposed within the mounting channels.

A second embodiment is an acoustical treatment assembly that similarly includes an absorption panel, a removable diffuser element, and a frame. The absorption panel includes an acoustically absorbent material. The removable diffuser element has a convex rounded shape and includes acoustically reflective material. The frame is configured to receive and support the absorption panel in a first configuration. The frame is further configured to receive and support the absorption panel and the removable diffuser element in a second configuration. The acoustical treatment assembly absorbs more sound in the first configuration than in the second configuration.

The adaptive assembly can thus be used in a room in the absorption configuration when the type of music or sound benefits from absorption, and can be used in the same room in the diffusion configuration when the type of music or sound benefits from reflection.

The above-described features and advantages, as well as others, will become more readily apparent to those of ordinary skill in the art by reference to the following detailed description and accompanying drawings.

DETAILED DESCRIPTION

Figure 1:
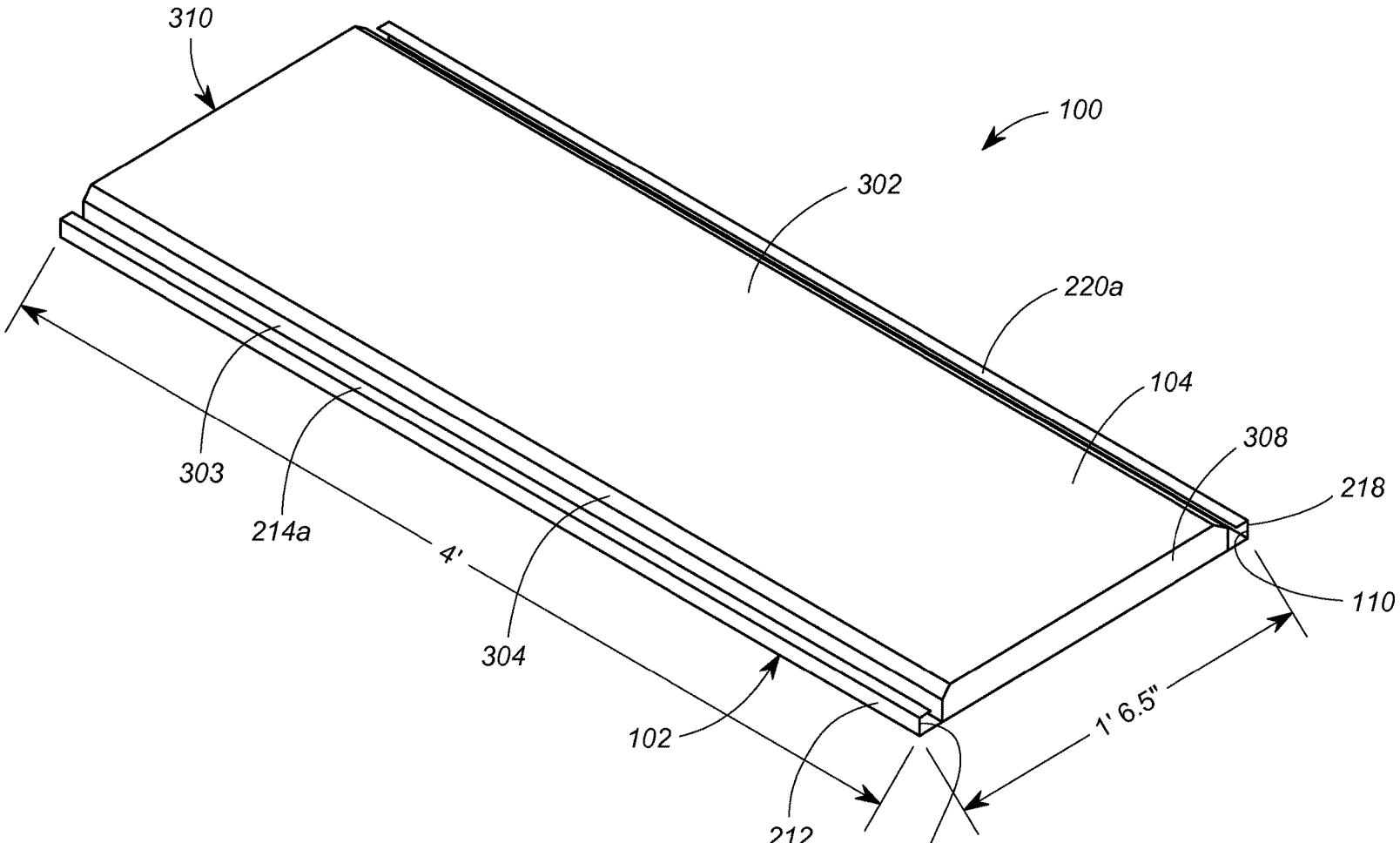
FIG. 1 shows a perspective view of an acoustical treatment assembly according to a first embodiment of the invention, wherein the acoustical treatment assembly is in a first configuration.
Figure 2:
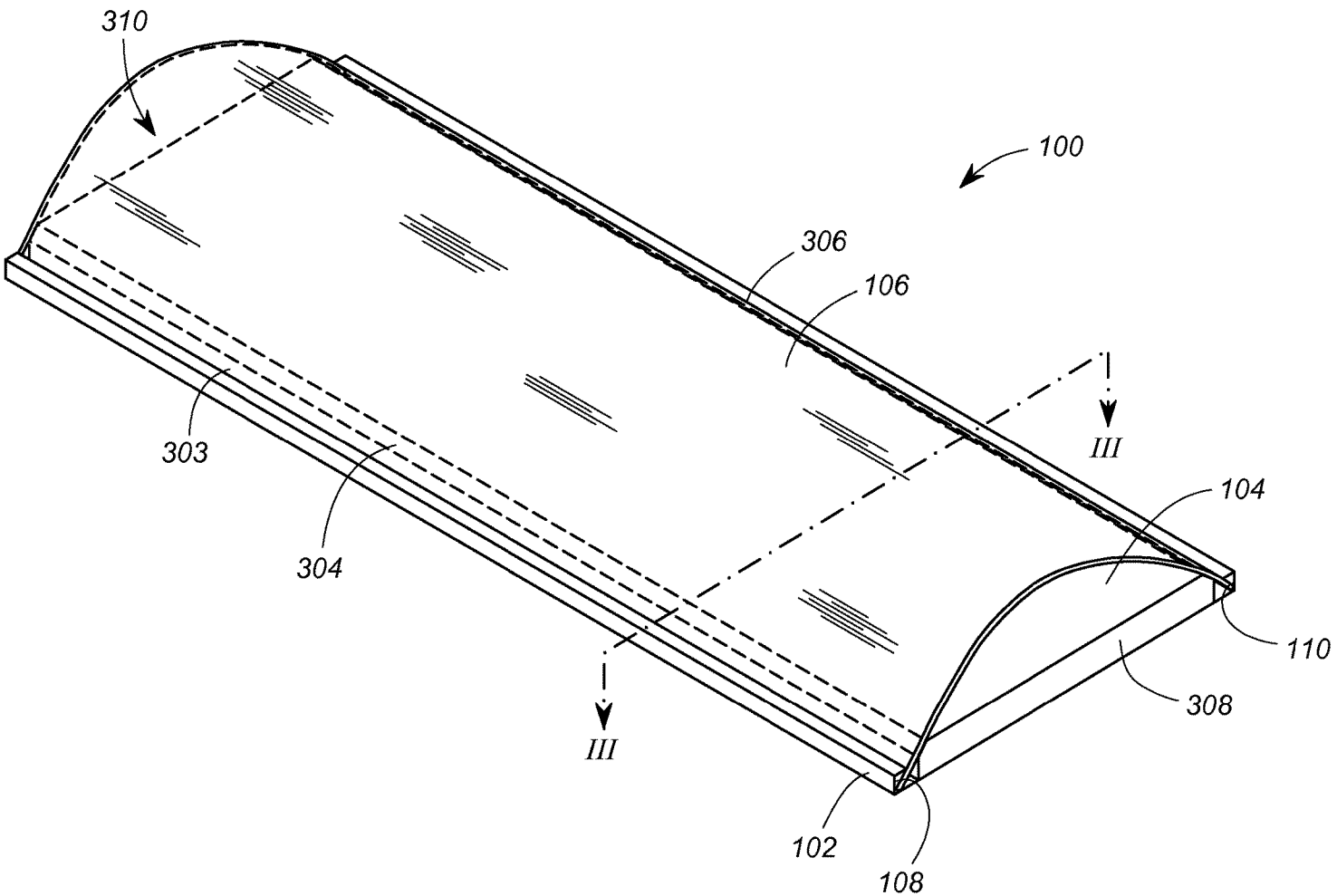
FIG. 2 shows a perspective view of the acoustical treatment assembly of FIG. 1 in a second configuration.
Figure 3:
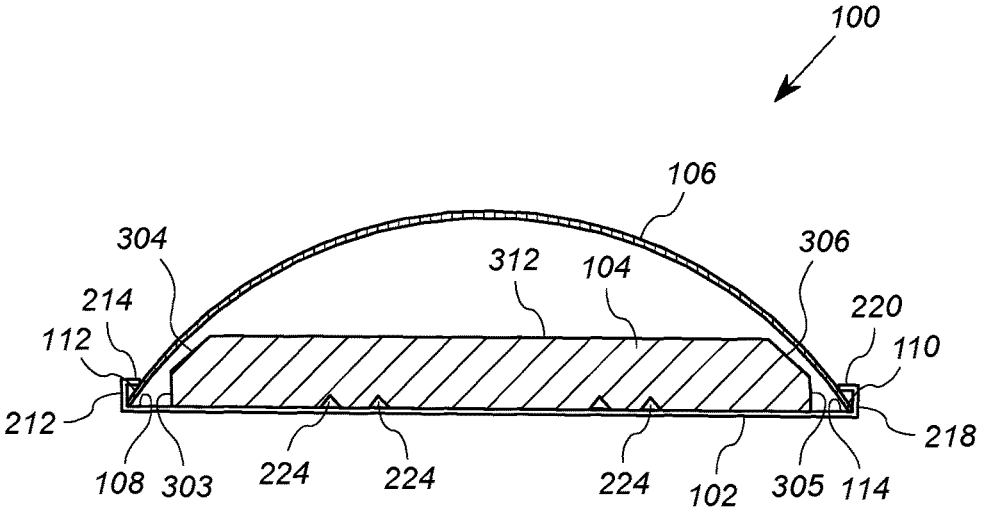
FIG. 3 shows a bottom cutaway view of the acoustical treatment assembly of FIG. 1 in the second configuration.

FIG. 1 shows a perspective view of an acoustical treatment assembly 100 according to a first embodiment of the invention. The acoustical treatment assembly 100 has a first configuration primarily for sound absorption, and a second configuration primarily for sound diffusion. FIG. 1 shows the acoustical treatment assembly 100 in the first configuration. FIG. 2 shows the acoustical treatment assembly 100 in the second configuration. FIG. 3 shows a bottom cutaway view of the acoustical treatment assembly 100 in the second configuration, taken along line III-III of FIG. 1.

With simultaneous reference to FIGS. 1-3, the acoustical treatment assembly 100 includes a frame 102, an absorption panel 104, and a removable diffuser element 106. The frame 102 is generally configured to support the absorption panel 104 in the first and second configurations as shown in FIGS. 1 and 2. The frame 102 includes opposing mounting channels 108 and 110 for supporting the removable diffuser element 106 in the second configuration. Further detail regarding a suitable example the frame 102 is provided below in connection with FIGS. 3 and 4. The absorption panel 104 is a panel formed at least in part from acoustically absorbent material. The absorption panel 104 is disposed on the frame 102 at least in part between the mounting channels 108 and 110. Further detail regarding the absorption panel is provided below in connection with FIG. 5.

The removable diffuser element 106 has or includes acoustically reflective material. As shown in FIGS. 2 and 3, the removable diffuser element 106 has a convex rounded shape when installed. As will be discussed below, the removable diffuser element 106 may suitably have a flat shape (or at least a less convex shape) when not installed. The removable diffuser element 106 has opposing edges 112, 114 that are disposed and retained within the respective mounting channels 108, 110. The removable diffuser element 106 is also constructed of a flexible material biased toward the flat or less convex shape. In the uninstalled position (see FIG. 7), the removable diffuser element 106 has a width from edge 112 to edge 114 that exceeds the distance between the mounting channels 108, 110. Accordingly, when the edges 112, 114 are in the respective mounting channels 108, 110, the diffuser element 106 is under tension and bows outward. As a consequence, the diffuser element 106 forms a consistent and continuous arc. This arc, combined with the acoustically reflective properties of the diffuser element 106, provides the sound diffusion properties when the diffuser element 106 is installed.

In operation, the frame 102 may be mounted on a wall, not shown, with the absorption panel 104 attached thereto as shown in FIG. 1. The frame 102 is mounted preferably such that the channels 108, 110 extend substantially vertically. If primarily sound absorption properties are desired, then the diffuser element 106 is not installed, and the absorption panel 104 is directly exposed to the sound waves in the room in which it is installed. The absorption panel 104 operates to absorb sound, which can reduce undesired echo or sound reflection.

In some cases, the type of music or other sounds in the room do not have severe sound reflection potential or sound reflection issues. In this case, the absorption qualities of the acoustical treatment assembly 100 in the first configuration are not necessary, and can even alter the response of the room in an undesirable way. In such cases, the diffuser element 106 is assembled onto the acoustical treatment assembly 100. To this end, user flexes or bows the diffuser element 106 such that the linear distance between the edges 112 and 114 is less than the distance between the channels 108 and 110. The edges 112, 114 of the diffuser element are then aligned with the channels 108 and 110. The user then slightly releases the tension so that the edges 112, 114 release into the channels 108, 110. When the user lets go, the edges 112, 114 are trapped within the channels 108, 110 but are under tension. The acoustical treatment assembly 100 is then in the second configuration, as shown in FIG. 2.

In the second configuration, the diffuser element 106 reflects sound. However, due to the convex arcuate surface of the reflective material, the sound reflections are diffused, which favorably changes the echo/sound reflection profile of the room.

When absorptive qualities are again favored, the diffuser element 106 may be removed using the same method, in reverse. Removal of the diffuser element 106 again places the acoustical treatment assembly in the first configuration, shown in FIG. 1.

Figure 4:
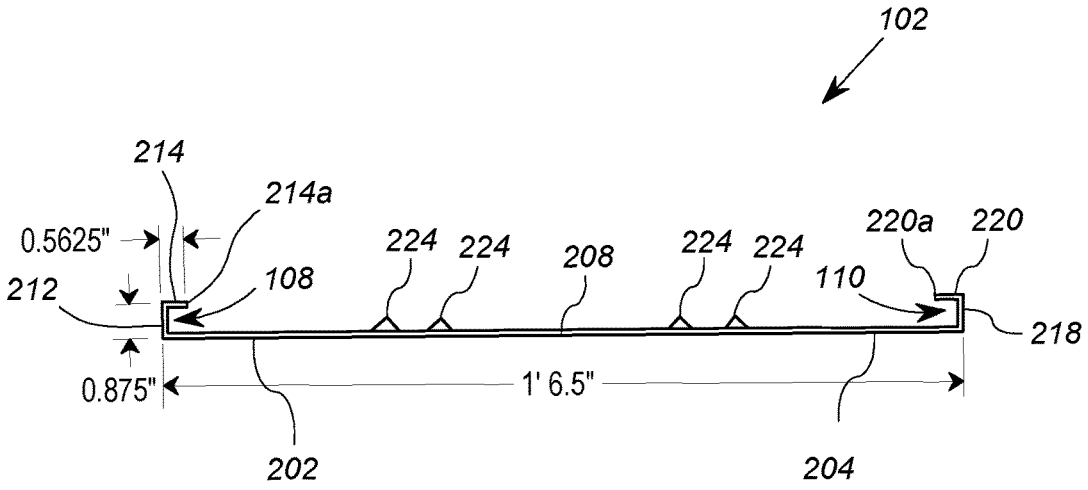
FIG. 4 shows a bottom plan view of the frame of the acoustical treatment assembly of FIG. 1.
Figure 5:
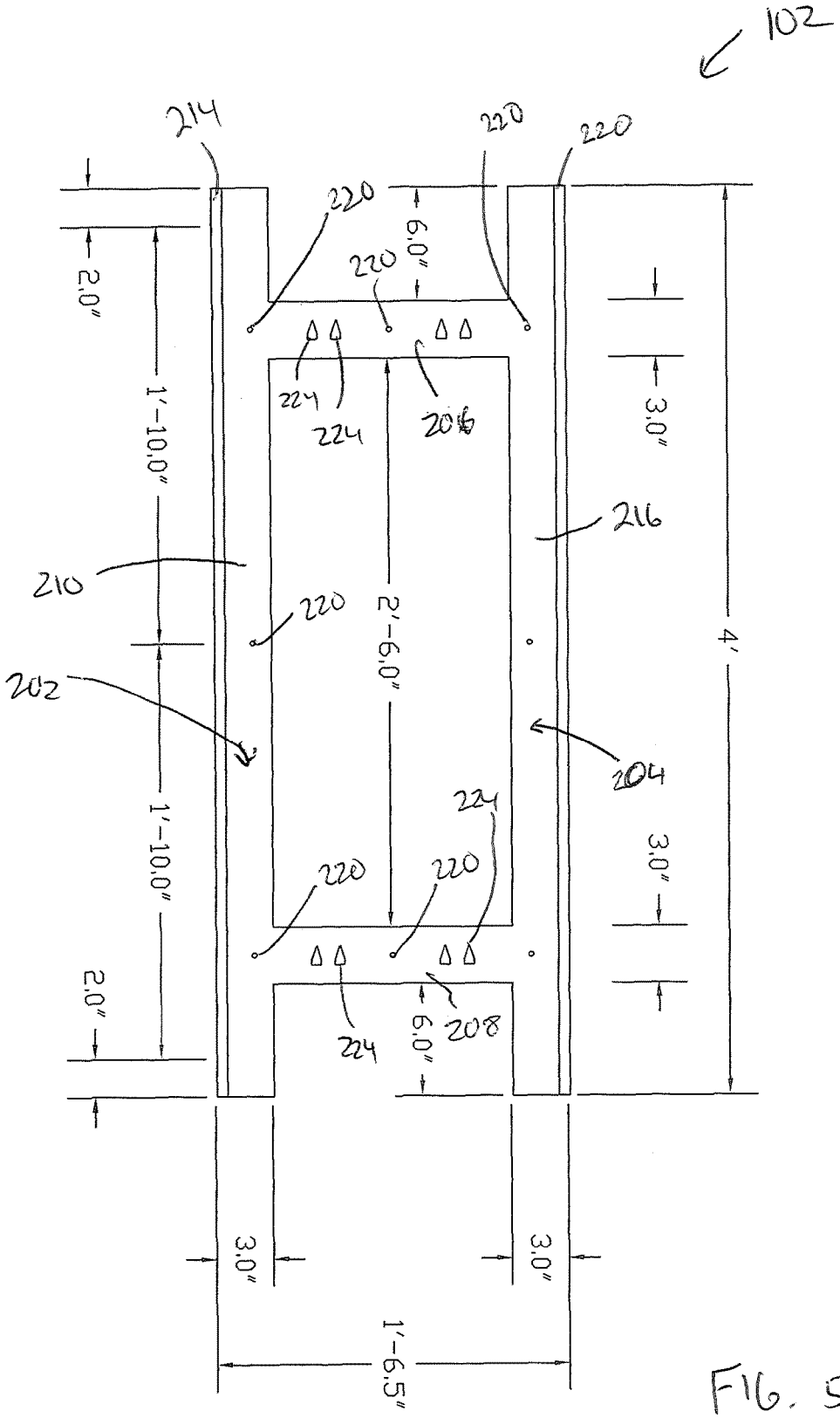
FIG. 5 shows a side plan view of the frame of the acoustical treatment assembly of FIG. 1.

FIG. 4 shows a bottom view of the frame 102. FIG. 5 shows a side plan view of the frame 102. With reference to FIGS. 4 and 5, the frame 102 includes first and second rails 202, 204 and first and second cross supports 206, 208. The first rail 202 in this embodiment includes a three-inch wide sheet 210, a side rim 212 and a top rim 214. The sheet 210 runs the length of the rail 202, which may suitably be forty-eight inches. The side rim 212 extends outward, preferably perpendicularly, from an outward edge of the sheet 210 and runs the length of the rail. The side rim 212 in this embodiment is between 0.75 and 1.00 inches wide, or in other words, extends approximately 0.75 and 1.00 inches in a direction perpendicular to the flat surface of the sheet 210. The top rim 214 extends from the outward edge of the side rim and runs along the length of the rail 202. The top rim 214 has a width of between 0.25 and 0.75 inches that extends in a direction toward the second rail, or in other words, laterally inward. The top rim 214 and the side rim 212 thus form the channel 108.

It will be appreciated that the top rim 214 and side rim 212 may extend at different angles and still form a channel 108 to trap the edge of the diffuser element 106. The second rail 204 has a substantially similar structure, but is in the mirror image of, the first rail 202. The second rail 204 therefore includes a corresponding sheet 216, side rim 218 and top rim 220 that cooperate form the channel 110. The distance between the side rims 212 and 218 is approximately 18 to 18.5 inches. The distance between the inside edges 214*a*, 220*a* of the respective top rims 214 and 220 is approximately 16.5" to 17.5".

Each of the sheets 210 and 216 in this embodiment includes a plurality of through holes 220 for receiving mounting screws or the like, which are used to mount the frame 12 to a wall or ceiling of a structure. The cross supports 206, 208 may also include similar through holes 220.

The first cross support 206 is formed of a similar three-inch wide metal sheet, and extends between and connects to the rails 202, 204. The second cross support 208 has a similar structure and also extends between and connects to the rails 202, 204. The first cross support 206 may suitably be located approximately 6 inches from first or bottom ends of the rails 202 and 204, and the second cross support 208 may suitably be located approximately 6 inches from second or top ends of the rails 202 and 204. It will be appreciated that the rails 202, 204 and the cross supports 206, 208 may be integrally formed, for example, stamped from sheet metal blank, or as injection molded polymer.

In this embodiment, each of the cross supports 206, 208 includes a plurality of barbs 224 extending upward and outward therefrom. Each barb 224 has a base 226 connected to the corresponding cross support 206 or 208, and extends upward from the base 226 to a point 228. The barbs 224 are used to engage and couple the absorption panel 104 to the base 102. This engagement is shown in FIG. 3

Figure 6:
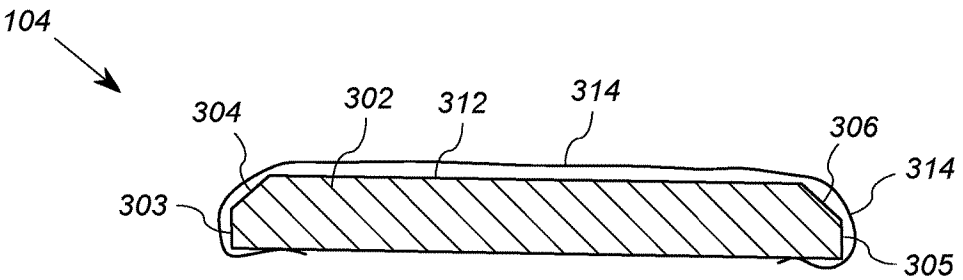
FIG. 6 shows a bottom cutaway view of the absorption panel of the acoustical treatment assembly of FIG. 1.

FIG. 6 shows a bottom cutaway view of an exemplary embodiment of the absorption panel 104 of FIG. 1. Referring now to FIGS. 1 and 6 simultaneously, the absorption panel 104 in this embodiment includes a substantially flat rectangular substrate 302 formed of acoustically absorbent fiberglass. However, it will be appreciated that shape other than rectangular may be used. It may be desirable to employ other shapes for visual aesthetic purposes, for example. The substrate 302 has a width that extends nearly the width between the inside edges 214*a*, 220*a* of the respective top rims 214, 220. Thus, the substrate 302 may be inserted onto the frame 102 (and onto the barbs 224) without interference of the top rims 214, 220. However, it will be appreciated that the substrate 302 may be slightly wider such that it partially occupies the channels 108, 110. To this end, the substrate 302 may be slid into position as opposed to being placed on. In yet other embodiments, the substrate 302 can be substantially less wide, although that would expose the frame to view, which may be undesirable. In any event, the length of the substrate 302 is preferably at least the length of the frame 102.

The substrate 302 may suitably have a thickness of two to eight inches (of sound absorbing material) depending the range of frequencies for which dampening is desired. In this embodiment, the substrate 302 includes top surface 312, opposite long side edges 303, 305, long chamfered edges 304, 306 and end edges 308, 310. Each of the chamfered edges 304, 306 forms a short inclined surface that extends in an approximate 45° angle from the top surface 312 to the corresponding long side edge 303, 305. In this embodiment, the substrate 302 under the top surface 312 has a uniform thickness throughout its entire rectangular footprint. However, it will be appreciated that the thickness need not be uniform. In the event that the thickness is not uniform, the substrate 302 preferably would have a mean thickness of two to eight inches. The chamfered edges 304, 306 may extend through one-half of the total thickness and the long edges 303, 305 may extend through one-half of the total thickness.

In some embodiments, such as shown in FIG. 6 (but not shown in FIG. 103), the absorption panel 104 further includes a fabric sheet 314 extending over at least a portion and preferably all of the top surface 312 of the substrate 302. In this embodiment, the fabric sheet 314 further extends over the chamfered edges 304, 306 and the side edges 303, 305. The fabric sheet 314 provides an aesthetic covering which may have a color selected for aesthetic purposes, or even a printed design. The fabric sheet 314 is preferably formed of acoustically transparent material. The fabric sheet 314 is pulled tightly over the side edges 303, 305 and edges 308, 310 of the substrate 302 and affixed to the underside (such that it is tautly stretched over the top surface 306) by adhesive and/or fasteners.

Figure 7:
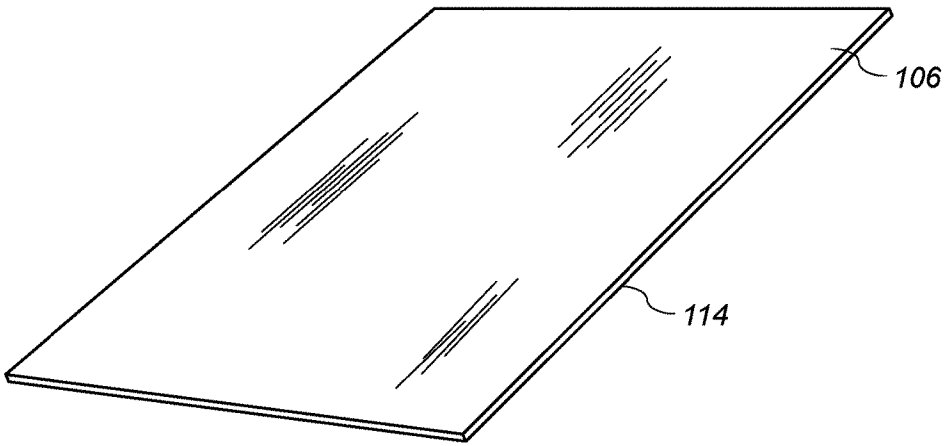
FIG. 7 shows a perspective view of the diffuser element of the acoustical treatment assembly of FIG. 1 removed from the assembly.

As shown in FIG. 7, the diffuser element 106 is formed from a flat sheet of plexiglass or other reflective material, preferably transparent, and has long side edges 112 and 114. The diffuser element 106 has a width (in the flat state of FIG. 7) from edge 112 to edges 114 that exceeds that of the width between the channels 108, 110. Thus, the diffuser element 106 must be flexed or bowed outward to be placed in the channels 108, 110. In the embodiment described herein the diffuser element 106 has width of 24" for use in the frame 102 which has a width between the side rims 212, 218 of 18" to 18.5". However, it will be appreciated that these dimensions may be scaled proportionately with advantageous results. This particular ratio of sheet width to installed width (approximately 4:3) provides for a continuous and consistent arc when installed, which provides favorable diffusing properties. However, other ratios may be employed depending on the room dimensions and desired sound profiles.

The diffuser element 106 has a thickness that is sufficient to allow bending or bowing by hand, but of sufficient strength not to fail or inelastically deform as a result of the bending necessary for installation. In this embodiment, the diffuser panel has a thickness of between 1/16" and 3/16", and preferably 1/8".

As discussed above, the embodiments described herein provide a convenient way to for a single fixture, i.e. the acoustical treatment assembly 100, to be used as either an acoustic absorber or an acoustic diffuser. An embodiment of the invention includes a corresponding method of using a single assembly as, at different times, an acoustic absorber or an acoustic diffuser.

Such a method includes providing the absorption panel 104 on the frame 102, and then using the absorption panel to absorb sound in a space. (See FIG. 1). The method also includes, at a subsequent time when absorption is less desirable, installing the diffuser element 106 on the frame 102 to cover the absorption panel 104. (See FIGS. 2 and 3). Because the diffuser element 106 is less acoustically absorbent and is configured to diffuse sound, subsequent music and sounds are absorbed to a lesser extent, and a more diffused throughout the space. The method also includes removing the diffuser element 106 from the frame 102 to uncover the absorption panel 104 at a later time, when it again is desirable to absorb sound at a greater extent. (See FIG. 1).

Figure 8:
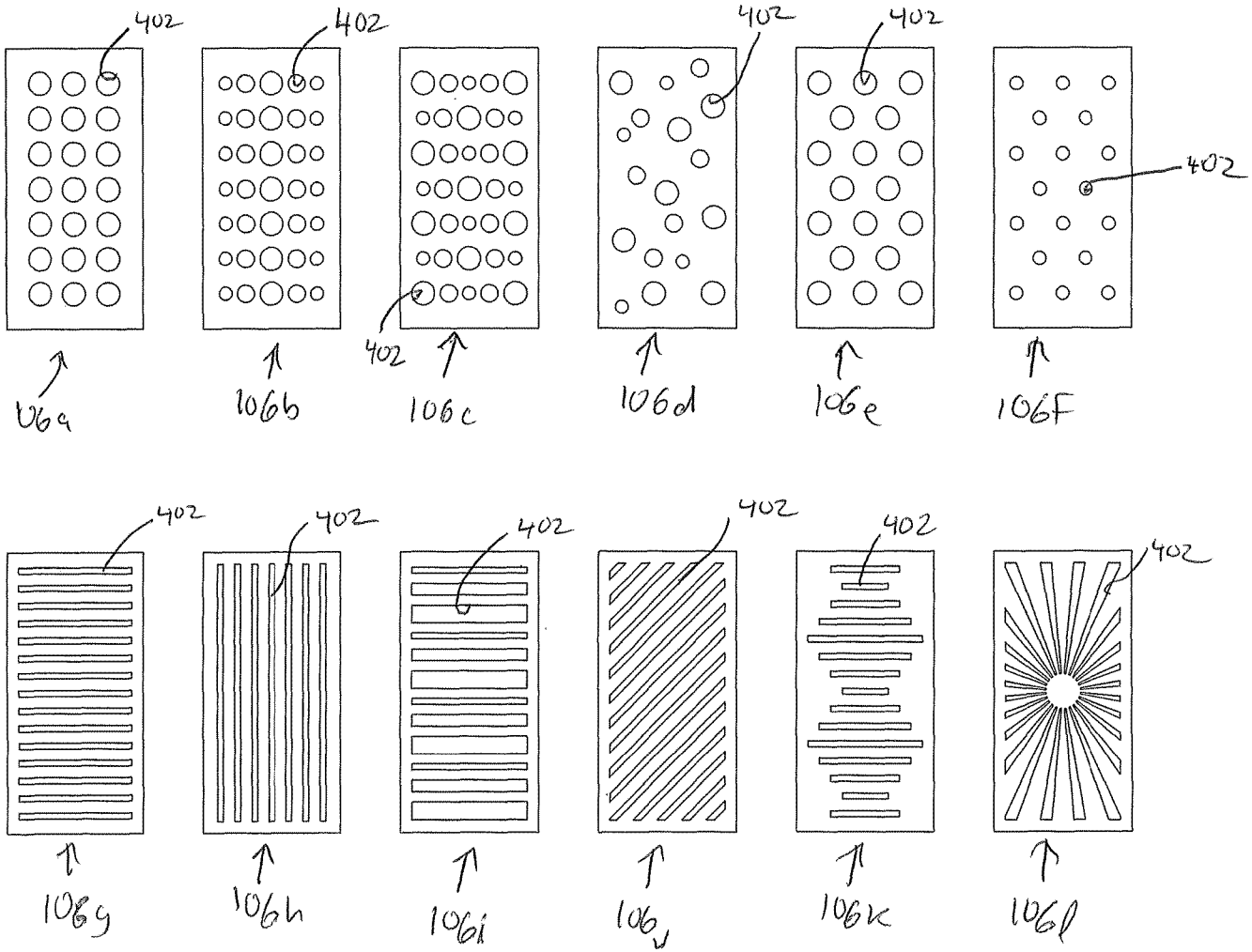
FIG. 8 shows side plan view of a plurality of alternative diffuser elements that may be used in the acoustical treatment assembly of FIG. 1, removed from the assembly.

In alternative embodiments, the diffuser element 106 may be replaced by a diffuser element that includes throughholes, perforations or other openings that allow more of the sound energy to reach the absorption panel 104. This feature allows for a single configuration of the assembly 100 (the configuration of FIG. 2) to include both diffusion and absorption qualities. FIG. 8 shows side plan view of a plurality of alternative diffuser elements 106*a*-106*l* that may be used in the acoustical treatment assembly 100 of FIG. 2. The diffuser elements 106*a*-106*l* are shown removed from the assembly 100, and thus in a flat state.

Each of the diffuser elements 106*a*-106*l* may have the same general construction of the diffuser element 106 of FIG. 7, except that each of the diffuser elements 106*a*-106*l* has perforations 402. It will be appreciated that the embodiments of FIG. 8 are merely examples of a nearly infinite variety of patterns of perforations that may be employed. The perforations 402 may be circular (106*a*-106*f*), rectangular (106*g*, 106*h*, 106*k*), or any other shape (106*i*, 106*l*). The perforations 402 may be arranged in rows (106*a*-106*c*, 106*e*, 106*f*, 106*g*, 106*i*, 106*k*), columns (106*a*-106*c*, 106*e*, 106*f*, 106*h*), or other arrangement (106*d*, 106*j*, 106*l*). The perforations 402 may be uniform in size and shape (106*a*, 106*e*-106*h*). The perforations 402 may be in an ordered pattern (106*a*-106*c*, 106*e*-106*l*) or in an unordered pattern (106*d*). The number, size and even pattern of perforations 402 can affect the amount of sound energy absorbed and reflected.

It will also be appreciated that achieving a mix of absorption and diffusion may be carried out by using multiple assemblies 100 in different configurations. For example, multiple assemblies that have the structure of the acoustical treatment assembly 100 may be employed in a single space, room or hall. The various assemblies may all be in the first configuration (FIG. 1), the second configuration (FIGS. 2 and 3) or a mix thereof, to achieve various balances of diffusion and absorption.

It will be appreciated that the above described embodiments are merely illustrative, and that those of ordinary skill in the art may readily devise their own implementations and modifications that incorporate the principals of the invention and fall within the spirit and scope thereof. For example, it will be appreciated that the assembly may vary significantly in size.

What is claimed is:

1. An acoustical treatment assembly comprising:

a frame having opposing mounting channels;

an absorption panel disposed on the frame and at least in part between the mounting channels, the absorption panel comprising acoustically absorbent material;

a removable diffuser element, the removable diffuser element having a convex rounded shape and having acoustically reflective material and having an internal spring force, wherein opposing edges of the diffuser element are trapped within the mounting channels by the internal spring force.

2. The acoustical treatment assembly of claim 1, wherein the removable diffuser element is flexibly trap fit between the opposing mounting channels.

3. The acoustical treatment assembly of claim 2, wherein removable diffuser element has an installed state and a removed state, and wherein the removable diffuser in the installed state has the convex rounded shape and in the removed state has a substantially flat state.

4. The acoustical treatment of claim 1, wherein the absorption panel has a mean thickness in the range of two inches to eight inches.

5. The acoustical treatment assembly of claim 4, wherein the absorption panel includes a fiberglass base and cover layer.

6. The acoustical treatment assembly of claim 5, wherein the cover layer comprises an acoustically transparent fabric.

7. The acoustical treatment assembly of claim 1, wherein the removable diffuse element comprises plexiglass.

8. The acoustical treatment assembly of claim 1, wherein the frame further comprises mounting spikes extending outwardly therefrom, and wherein the absorption panel is mounted on the mounting spikes.

9. The acoustical treatment assembly of claim 1, wherein the convex rounded shape has a consistent arc.

10. The acoustic treatment assembly of claim 4, wherein the absorption panel includes chamfered edges that extend parallel to the opposing edges of the diffuser element.

11. An acoustical treatment assembly comprising:

an absorption panel comprising acoustically absorbent material;

a removable diffuser element having a convex rounded shape and comprising acoustically reflective material;

a frame configured to receive and support the absorption panel in a first configuration, and further configured to receive and support the absorption panel and the removable diffuser element in a second configuration, such that the acoustical treatment assembly absorbs more sound in the first configuration than in the second configuration wherein at least a first portion of the absorption panel is covered by the diffuser element in the second configuration, and the first portion of the absorption panel is uncovered in the first configuration.

12. The acoustical treatment assembly of claim 11, wherein the removable diffuser element is flexibly trap fit between features of the frame in the second configuration.

13. The acoustical treatment assembly of claim 11, wherein the diffuser element includes a plurality of perforations.

14. A method, comprising:

a) supporting an absorption panel comprising acoustically absorbent material on a frame;

b) using the absorption panel to absorb sound in a space;

c) installing diffuser element on the frame to cover the absorption panel, the diffuser being less acoustically absorbent than the absorption panel, the diffuser configured to diffuse further sound in the space; and d) removing the diffuser element from the frame to uncover the absorption panel to use the absorption panel to absorb additional sound in a space.

15. The method of claim 14, wherein the frame includes opposing channels, and wherein step c) further comprises inserting edges of the diffuser element into the opposing channels.

16. The method of claim 15, wherein step c) further comprises bending the diffuser element to place the edges of the diffuser element into the opposing channels.

17. The method of claim 16, wherein the diffuser element comprises an acoustically reflective material.

* * * * *